US005696474A

United States Patent [19]

Spivey et al.

[11] Patent Number: 5,696,474

[45] Date of Patent: Dec. 9, 1997

[54] HIGH FREQUENCY HERMETICALLY SEALED ELECTRICAL FEED THROUGH CONNECTOR

[75] Inventors: Thomas Paul Spivey, Sunnyvale; Jeffrey Charles Allard, San Jose; John Vincent Bellantoni, Redwood City, all of Calif.

[73] Assignee: Watkins-Johnson Company, Palo Alto, Calif.

[21] Appl. No.: 577,257

[22] Filed: Dec. 22, 1995

[51] Int. Cl.[6] ..... H01P 1/04

[52] U.S. Cl. ..... 333/245; 333/260

[58] Field of Search ..... 333/32–34, 245–248, 333/254, 260

[56] References Cited

U.S. PATENT DOCUMENTS

| | | | |
|---|---|---|---|
| 4,868,639 | 9/1989 | Tama et al. | 257/699 |
| 4,951,011 | 8/1990 | Heckaman et al. | 333/33 |
| 5,019,829 | 5/1991 | Heckman et al. | 343/700 MS |
| 5,170,142 | 12/1992 | Bier | 333/245 |
| 5,175,611 | 12/1992 | Richardson et al. | 257/699 |
| 5,508,666 | 4/1996 | Nguyen | 333/260 X |

OTHER PUBLICATIONS

Specification Sheet: "Wiltron K–Connector: Microstrip to K Female Flange Mount Connector, Part No. K103F." [P/N: 10200–00024, Rev. C; © 1985 Wiltron Company].

*Primary Examiner*—Benny T. Lee
*Assistant Examiner*—Barbara Summons
*Attorney, Agent, or Firm*—Flehr Hohbach Test Albritton & Herbert LLP

[57] ABSTRACT

A high frequency hermetically sealed electrical feed through connector extending through an electronic device package for efficiently coupling a signal transmitted through the connector. The connector feeds through an opening in the wall of the package, and generally comprises three coaxial transmission line sections, the first line section being defined by a section of the wall opening having a predetermined diameter, an axial lead and a dielectric sleeve. The second line section is defined by the axial lead and a section of the wall having a larger diameter than the predetermined diameter. The third line section is defined by the axial lead and a section of the wall having a reduced diameter.

12 Claims, 3 Drawing Sheets

HIGH FREQUENCY HERMETICALLY SEALED ELECTRICAL FEED THROUGH CONNECTOR

This invention relates generally to electrical connectors and more particularly to a high frequency hermetically sealed electrical connection extending through the wall of an electronic device.

BACKGROUND OF THE INVENTION

Packages of integrated circuit components come in a variety of forms. For certain applications, such as high frequency microwave integrated circuits (MIC), the electronic packaging must meet critical design criteria such as unique dimensional tolerances, thermal performance, hermeticity, and internal to external impedance matched microwave transistions.

Of particular importance are the electrical feed through connections typically made through the package wall, which serve to connect the circuitry housed inside the package to external elements, such as a coaxial cable connector assembly, waveguide or the like. Typically feed through connections comprise a coaxial line formed by a hole in the package wall and a center conductor supported by a glass bead, sealed to the center conductor and the package wall.

There are two known methods by which the glass seal assembly may be placed into the package; (i) the glass seal assembly (glass bead and lead) are fired into a metal sleeve which is then soldered into the feedthrough hole in the package, or (ii) the glass bead and terminal are fired directly into the feedthrough hole in the package. It is important that the glass seal provide a hermetic seal between the circuitry housed in the package and the external environment. A fired in glass seal is known to provide greater reliability and yield in regards to hermeticity as opposed to a glass seal assembly that is soldered into the package wall.

The feed through connector functions as a coaxial connection allowing transmission of signals through the device package. Typically, a constant impedance of 50 ohms for the connection is employed. At high frequencies, a compensation ring may be added to the connector to compensate for an impedance mismatch, such as when transitioning from a glass to an air dielectric between the external and internal of the connection. When operating at frequencies in the extended microwave range (up to 40 GHz) any impedance mismatch may introduce prohibitive signal coupling loss. Accordingly it is important to provide a connection which includes a suitably designed compensation ring.

A limitation encountered with device packages occurs when a fired in glass seal is used in conjunction with a compensation ring. In particular, when the glass seal is fired into the package wall, it is heated to a liquidus state, and the glass flows into the compensation ring area. This adversely effects, and often destroys, the impedance matching characteristic of the compensation ring. Thus, a glass seal assembly must be soldered into the package to maintain a glass free compensation ring. It is desirable to fire in glass seals instead of soldering them since hermeticity is more readily achieved with the fired in seal. Accordingly, a feed through connector able to couple high frequencies while providing for the use of fired in glass seals is needed.

OBJECTS AND SUMMARY OF THE INVENTION

It is therefore an object of the present invention to provide an improved electrical feed through connector.

More particularly, it is an object of the invention to provide a hermetically sealed electrical connection capable of operating at high frequencies while exhibiting acceptable insertion and return loss properties.

It is a further object of the present invention to provide a feed through connection including a compensation ring and a fired in glass seal, in which the glass does not substantially flow into the compensation ring during firing.

Another object of the invention is to provide a feed through connector providing a hermetic glass-to-metal seal.

These and other objects and advantages of the present invention are achieved by a connector which feeds through an opening in the wall or floor of an electronic device package, comprising a first coaxial transmission line section which is defined by a section of the wall opening having a predetermined diameter, an axial lead and a dielectric sleeve coaxially supporting the lead from the wall. A second transmission line section defined by the axial lead and a section of the wall having a larger diameter than the predetermined diameter, and a third coaxial transmission line section defined by the axial lead and a section of the wall having a reduced diameter. Each coaxial transmission line section has an associated impedance which provide an impedance matching network to efficiently couple a signal transmitted through the connection.

BRIEF DESCRIPTION OF THE DRAWINGS

Additional objects and features of the invention will be more readily apparent from the following detailed description and appended claims when taken in conjunction with the drawings, wherein:

DETAILED DESCRIPTION OF THE INVENTION

Figure 1:
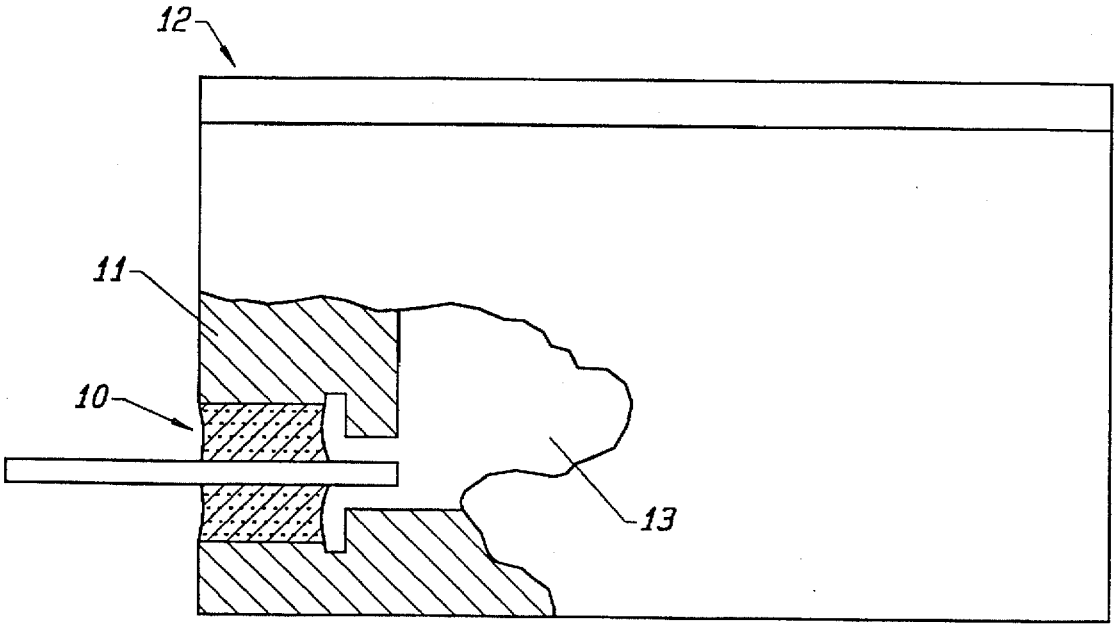
FIG. 1 shows a device package partly in section illustrating a feedthrough in accordance with the present invention.
Figure 2:
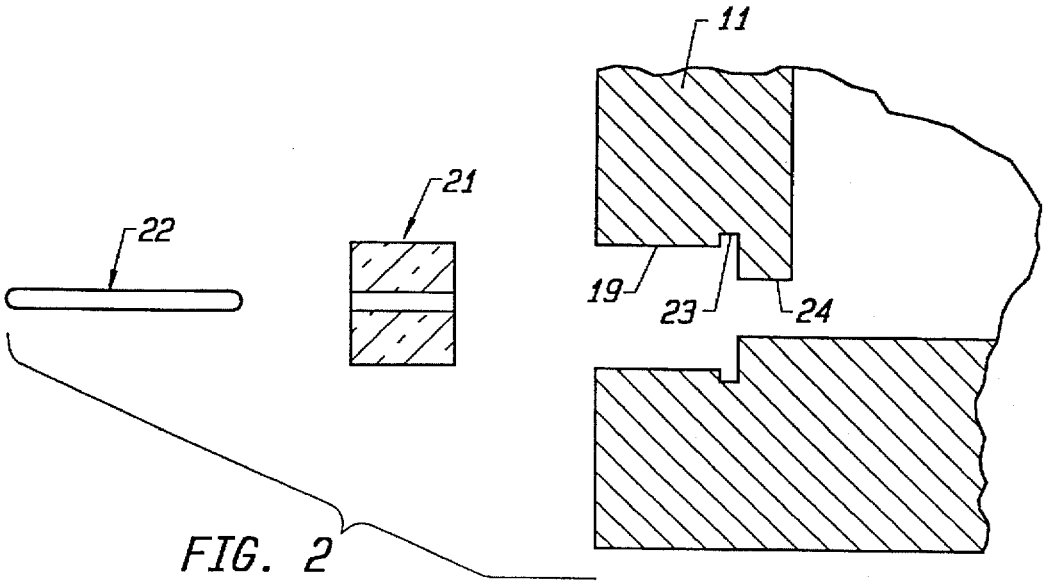
FIG. 2 is an enlarged exploded view of the feed through of FIG. 1.
Figure 3:
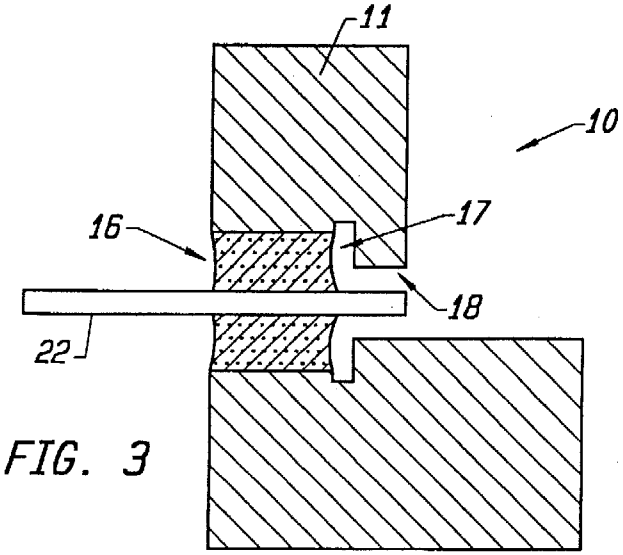
FIG. 3 is an enlarged cross-sectional side view of the feed through assembly of FIG. 1.

Turning to the drawings, wherein like components are designated by like reference numbers in the figures, FIGS. 1 through 3 show a device package with a feed through connection in accordance with the present invention. The feed through connector is referred to by the general reference character 10. The connection extends through an opening in a wall 11 of the electronic device package 12, the wall 11 being part of the package which defines a cavity 13. The cavity 13 houses various circuit components (not shown). Although the opening is generally described as being placed in a wall of the package, it is to be understood that the opening may be placed in a side wall of the package, or alternatetivley may be placed in the floor of the package.

To couple a signal to the device, the inventive connection generally includes three coaxial line sections, 16, 17 and 18 formed within the package wall 11. The first coaxial transmission line section 16 is defined by the wall portion 19 of the opening formed in the wall 11. The portion 19 has a predetermined diameter, and a dielectric sleeve or bead 21, preferably comprised of glass, which supports an axial lead 22 from the package wall 11. Preferably, the dielectric bead 21 and axial lead 22 are fired into first coax line section 16, which is discussed in further detail below.

Second coaxial line section 17, also referred to as the compensation ring, is formed within the package wall 11 and is defined by the axial lead 22, and wall portion 23 having a larger diameter. To complete the path into cavity 13, a third coaxial line section 18, is formed within the package wall 11. The third section is defined by the axial lead 22, and wall portion 24 having a smaller diameter than the diameters of portions 19 and 23. The axial lead 22 passes through the first, second and third coaxial line sections 16, 17 and 18, respectively, and protrudes into the cavity 13 where it is connected by various known means to a terminal leads on the circuit housed within the package, thereby providing for transmission of a signal to and from the circuit.

The dielectric bead 21 and axial lead 22 are fired into the package 12 such that the bead/axial lead assembly is sealed, supported from the wall portion 19, and forms an air tight seal between the cavity 13 of the package 12 and the exterior environment.

Of particular advantage and in contrast to the prior art, the dielectric bead 21 does not significantly contact the second coaxial line section 17, even after firing the bead/axial lead assembly into place. During the firing process, the glass bead is heated to its liquidus state whereby the glass bonds to the package wall portion 19 creating a hermetic glass-to-metal seal. The enlarged diameter wall line portion 23 inhibits flow of the glass into its area due in part to the surface tension of the glass in its liquidus stage which tends to prevent the glass from flowing into the larger area. Moreover, during any subsequent annealing of the package where the glass is heated, the second coaxial line section 17 remains substantially glass free. A detailed description of the firing process that may be used in the present invention is found in U.S. Pat. No. 5,175,611.

Figure 4:
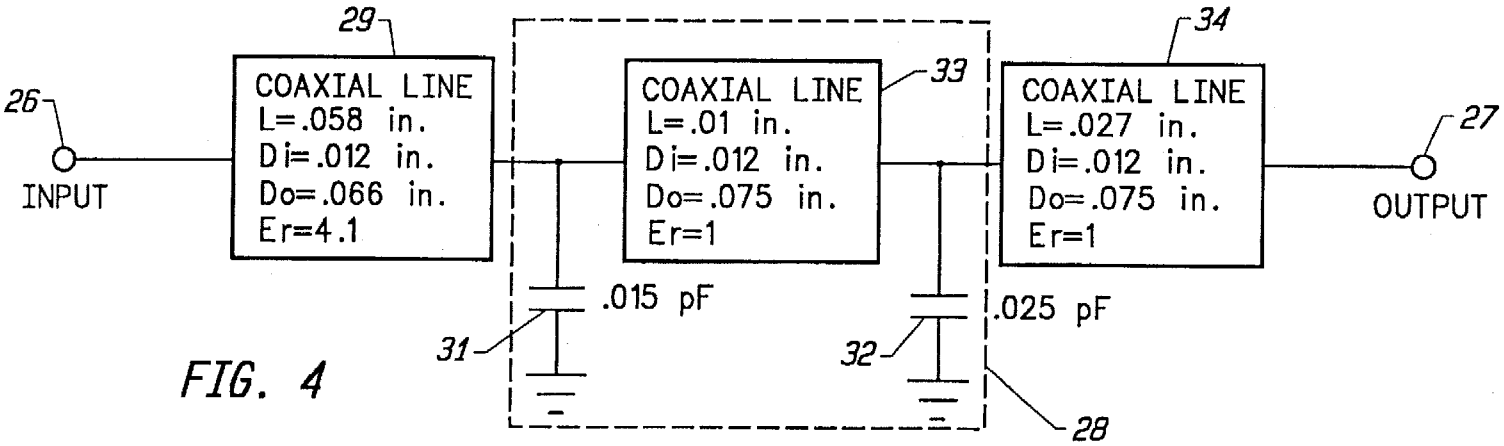
FIG. 4 depicts an electrical model of the connector in the present invention.

In order to efficiently couple a signal to the circuitry housed in the package 12, with reduced insertion and return loss, it is desirable to achieve a good impedance match though the transmission connection. The electrical characteristics of the present invention are shown with reference to FIGS. 3 and 4. FIG. 3 is an exemplary cross-sectional view of the connector according to the invention and FIG. 4 is the electrical schematic of the connector of FIG. 3. Preferably, the impedance of the transmission line from the point of input 26 to the point of output 27 will be matched to 50 ohms.

In general, the characteristic impedance of each coaxial line section is governed by the known equation:

$$Zo = \frac{60}{\sqrt{Er}} \operatorname{Ln}\left(\frac{Do}{Di}\right)$$

where Do is the diameter of the outer conductor, Di is the diameter of the inner conductor, and Er is the relative dielectric constant of the dielectric between the inner and outer conductors.

Referring again to FIGS. 3 and 4, exemplary dimensions of first coaxial transmission line section 16 is represented by block 29. Preferably first coaxial line 16 has a length of 0.058 inches, an outer diameter of 0.066 inches and an inner diameter of 0.012 inches, with a glass dielectric material between the inner and outer conductors, said dielectric having an Er=4.1. At the interface between the first coaxial line section 16 and the second coaxial line section 17 a discontinuity is encountered due to the change in the outer diameter and the change from the glass dielectric to the air dielectric. The discontinuity creates a parasitic capacitance. Another parasitic capacitance is created from the discontinuity in the outer diameter of the coaxial line at the interface of the second and third coaxial line sections 17 and 18. The reactive components are matched by impedance matching network 28 wherein the second coaxial line section 17 is represented by block 33 and preferably has the following dimensions: length of 0.01 inches, outer conductor diameter of 0.075 inches, inner conductor diameter of 0.012 inches and Er=1.0. The preferred values of capacitors 31 and 32 are 0.015 pF and 0.025 pF, respectively. To complete the connection, the third coaxial line section 18 is represented as block 34 and preferably has an inner conductor diameter of 0.012 inches, an outer conductor diameter of 0.027 inches, a length of 0.027 inches and Er=1.0. While the preferred embodiment has been described with reference to specific dimensions, it is to be understood that the dimensions may vary with corresponding variation in the impedance's according to the equation set forth above.

Figure 5:
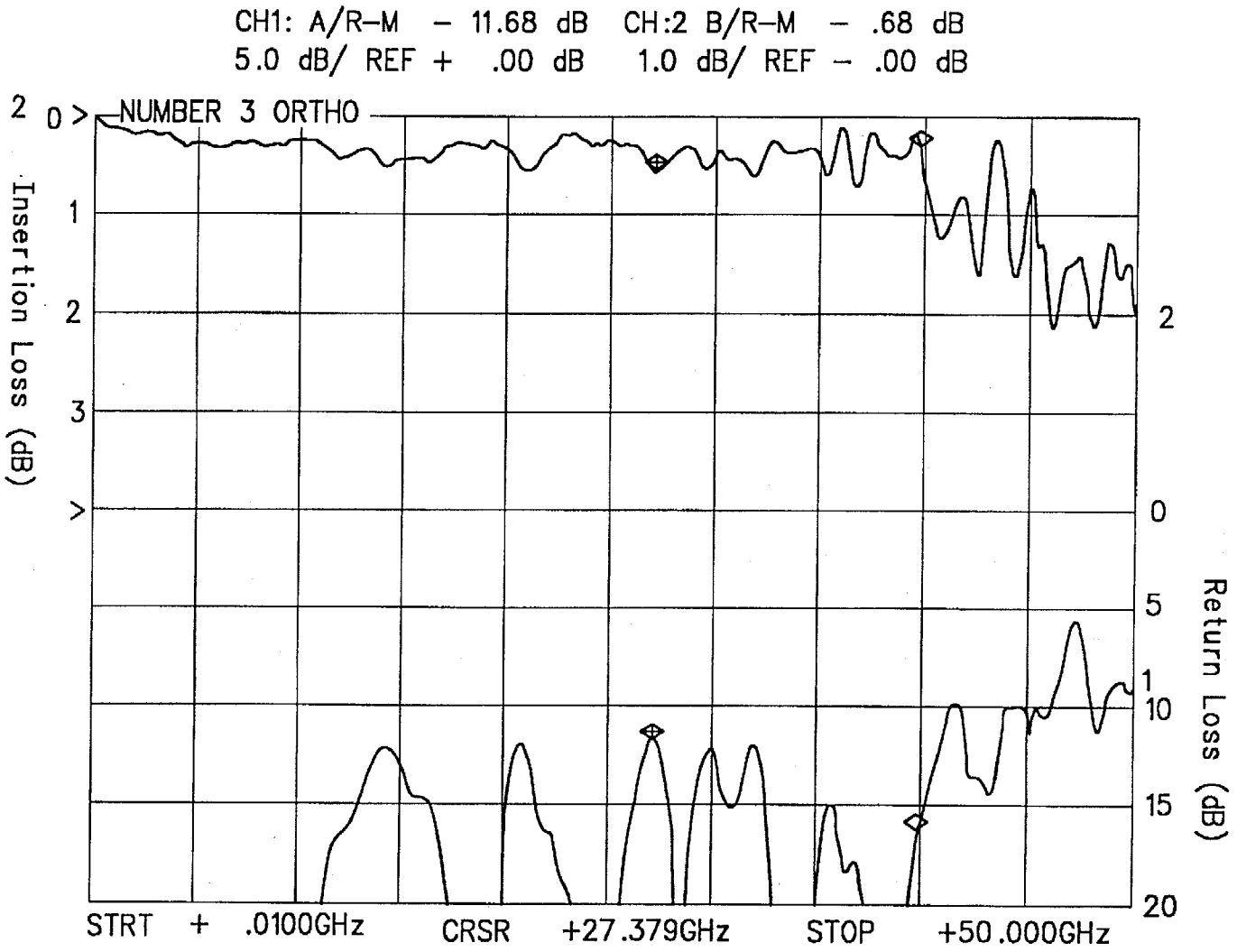
FIG. 5 is a graph illustrating the insertion and return loss performance achieved with two inventive connectors interconnected with 0.3 inches of microstrip transmission line of 50 ohm impedance.

FIG. 5 shows the insertion loss and return loss performance of two connectors having the aforementioned dimensions, which were interconnected with 0.3 inches of microstrip transmission line. The insertion loss is measured from input point 26 to output point 27, through the microstip line, and then from output point 27 back to input point 26. This represents the energy loss resulting from the transmission of a microwave frequency signal between these points. The return loss is measured from input 26 to the output 27, through the microstrip line and then from output point 27 back to input point 26, and represents the energy reflected back from the output 27. As illustrated in FIG. 5, insertion and return loss are small over a broad frequency range of 0.01 GHz to 50.0 GHz, thus indicating that a good impedance match has been achieved with the 50 ohm microstrip line over a broad frequency range.

Manufacturing of the inventive connector requires special considerations, due to the enlarged diameter of the second coaxial line section 17 formed in the package wall 11. To manufacture the connector, the steps employed are generally as follows: first a feed through hole is drilled through the package wall 11, the hole having a diameter equal to the outer conductor diameter of the third coaxial transmission line section 18. The feed through is finished by known machining techniques to achieve the desired finish and tolerances. Second, a flat bottom hole is drilled to a depth within the package wall 11 that equals the total length of the first and second coaxial transmission line sections 16 and 17. By way of example, using the length dimensions of line sections 16 and 17 (0.058 and 0.01 inches, respectively) described in FIG. 4, the flat bottom hole would be drilled to a depth of 0.068 inches. The third step involves undercutting to form the second coaxial line section 17 (often referred to as the compensation ring) with a tool generally shaped as a T. The dimensions of the cutting end section of the tool are based on the dimensions of the first and second coaxial line sections 16 and 17. To cut the outer diameter of the second coaxial transmission line 17, the cutting end section is moved outwards in a circular path until the full outer diameter of the second coaxial line section 17 has been formed in the package wall 11.

The foregoing description of specific embodiments of the invention have been presented for the purpose of illustration and description. They are not intended to be exhaustive or to limit the invention to the precise forms disclosed, and obviously many modifications, embodiments, and variations are possible in light of the above teaching. It is intended that the scope of the invention be defined by the claims appended hereto and their equivalents.

We claim:

1. An electrical feed through connection extending through an opening in a wall of an electronic package for transmission of a signal comprising:

a first coaxial transmission line section defined by a portion of the opening having a predetermined diameter and an axial lead coaxially supported from the wall by a fired in dielectric bead which extends solely in said first coaxial line section;

a second coaxial transmission line section defined by the axial lead and a portion of the opening having a larger diameter than said predetermined diameter; and a third coaxial transmission line section defined by the axial lead and a portion of the opening having a diameter smaller than said predetermined diameter, wherein said second coaxial transmission line section is disposed between said first and third coaxial transmission line sections to inhibit the flow of said dielectric bead.

2. The connection of claim 1 wherein said dielectric bead is glass.

3. The connection of claim 1 wherein the signal transmitted through said connection is in the range of approximately DC to 40 G Hz.

4. The connection of claim 1 wherein the signal transmitted through said connection is in the range of approximately 20 G Hz to 40 G Hz.

5. An electrical connector extending through an opening in a wall of an electronic device package for transmission of a signal into and out of said package, wherein:

said connector comprises a plurality of coaxial transmission line sections defined by wall portions of said opening and a coaxial lead, said plurality of coaxial transmission line sections comprising a first coaxial transmission line section to support said lead coaxially by a fired in dielectric bead which extends solely in said corresponding wall portion, and a second coaxial transmission line section adjacent to said first coaxial transmission line section, said second coaxial transmission line section has a larger diameter than said first coaxial transmission line section to inhibit the flow of said dielectric bead.

6. The connector of claim 5 wherein the signal transmitted through said connector is in the range of approximately DC to 40 GHz.

7. The connector of claim 5 wherein said dielectric bead is glass.

8. The connector of claim 5 wherein the signal transmitted through said connector is in the range of approximately 20 G Hz to 40 G Hz.

9. An electronic device package, comprising:

a housing having a cavity;

a substrate attached within the cavity of said housing;

at least one feedthrough connection extending through an opening in a wail of said package for transmission of a signal, wherein said at least one feedthrough connection comprises a plurality of coaxial transmission line sections defined by wall portions of said opening and a coaxial lead, said plurality of coaxial transmission line sections comprising a first coaxial transmission line section to support said lead coaxially by a fired in dielectric bead which extends solely in said corresponding wall portion;

a second coaxial transmission line section adjacent to said first coaxial transmission line section, and having a larger diameter than said first coaxial transmission line section to inhibit the flow of said dielectric bead;

and a third coaxial transmission line section adjacent to said second coaxial transmission line section, and having a diameter smaller than said first coaxial transmission line section.

10. The package of claim 9 wherein said dielectric bead is glass.

11. The connector of claim 9 wherein the signal transmitted through said connection is in the range of approximately 20 G Hz to 40 G Hz.

12. The package of claim 9 wherein the signal transmitted through said feedthrough connection is in the range of approximately DC to 40 GHz.

* * * * *